US007631639B2

(12) United States Patent
Yonebayashi et al.

(10) Patent No.: US 7,631,639 B2
(45) Date of Patent: Dec. 15, 2009

(54) OIL SEPARATOR FOR BLOWBY GAS

(75) Inventors: Minoru Yonebayashi, Toyota (JP); Nobutaka Takeuchi, Nishikamo-Gun (JP); Shigeki Yasuhara, Toyota (JP); Kaoru Ito, Okazaki (JP); Toshimitsu Tanaka, Toyota (JP)

(73) Assignees: Kojima Press Industry Co., Ltd., Toyota-Shi (JP); Toyota Jidosha Kabushiki Kaisha, Toyota-Shi (JP); Uchihama Kasei Co., Ltd., Toyota-Shi (JP)

( * ) Notice: Subject to any disclaimer, the term of this patent is extended or adjusted under 35 U.S.C. 154(b) by 162 days.

(21) Appl. No.: 11/685,227

(22) Filed: Mar. 13, 2007

(65) Prior Publication Data

US 2007/0215128 A1 Sep. 20, 2007

(30) Foreign Application Priority Data

Mar. 20, 2006 (JP) ..... 2006-075982

(51) Int. Cl.
*F01M 13/04* (2006.01)
*F02F 7/00* (2006.01)

(52) U.S. Cl. ..... 123/572

(58) Field of Classification Search ..... 123/572–574, 123/41.86

See application file for complete search history.

(56) References Cited

U.S. PATENT DOCUMENTS 4,627,406 A * 12/1986 Namiki et al. ..... 123/573
4,993,375 A * 2/1991 Akihiko ..... 123/90.38
6,591,820 B2 * 7/2003 Kitano et al. ..... 123/572
6,672,294 B1 * 1/2004 Pirone ..... 123/572
6,725,849 B2 * 4/2004 Stegmaier et al. ..... 123/572
7,246,612 B2 * 7/2007 Shieh et al. ..... 123/572
7,380,545 B2 * 6/2008 Shieh et al. ..... 123/572
2001/0032635 A1 * 10/2001 Kimura ..... 123/572
2002/0014229 A1 * 2/2002 Nishi et al. ..... 123/572
2002/0046744 A1 * 4/2002 Suganami et al. ..... 123/572
2002/0083934 A1 * 7/2002 Ruehlow et al. ..... 123/573
2005/0092267 A1 * 5/2005 Nonaka et al. ..... 123/41.86
2007/0295315 A1 * 12/2007 Guerry et al. ..... 123/572

FOREIGN PATENT DOCUMENTS

JP 2000-045750 A1 2/2000
JP 2004-204811 A1 7/2004

* cited by examiner

*Primary Examiner*—M. McMahon
(74) *Attorney, Agent, or Firm*—Burr & Brown

(57) ABSTRACT

There is provided an oil separator for blowby gas exhibiting excellent oil separation performance in a stable manner. In a common flow path section of a gas flow passage in which the blowby gas flows and an oil passage provided with a bottom of the common flow path section where oil that has been separated from blowby gas by separation means provided midway along the gas flow passage, the width of a part of the common flow path section is regulated so as to become gradually smaller towards the bottom of the common flow path section, and a flow passage regulating section, for making part of the common flow path section that has the width regulated a restricted section, is provided so as to extend upwards from the bottom of the common flow path section.

8 Claims, 6 Drawing Sheets

OIL SEPARATOR FOR BLOWBY GAS

The present application is based on Japanese Patent Application No. 2006-075982 filed on Mar. 20, 2006, the contents of which are incorporated herein by reference.

BACKGROUND OF THE INVENTION

1. Field of the Invention

The present invention relates to an oil separator for a blowby gas containing oil mist, and particularly relates to a novel structure of an oil separator for a blowby gas containing oil mist to separate the oil mist contained in the blowby gas generated inside an internal combustion engine.

2. Discussion of Related Art

As is well known, in an internal combustion engine, such as an engine of a car, at the time of operating the engine, a blowby gas containing a large amount of unburned hydrocarbons inevitably leaks out from gaps between piston rings and cylinder walls to an inside of a crankcase. As a result, in this type of vehicle engine, the blowby gas is often forcibly flowed inside an intake pipeline utilizing negative pressure inside the intake pipeline, returned once more to the combustion chamber, and combusted again.

Meanwhile, an oil mist, that is a lubricating oil such as an engine oil made into a mist state and dispersed, is also contained within the blowby gas. Therefore, conventionally, for the purpose of reducing an amount of oil carried away due to commingling of the oil with the blowby gas, and preventing pollution due to the oil in the intake pipeline, an oil separator for separating the oil mist from within the blowby gas has been provided in various configurations, such as at an inner side of a cylinder head cover, and at a mid point of a connecting passage connecting a crankcase and the intake pipeline.

As this type of oil separator, is known, for example, as an oil separator comprising: a gas flow passage for allowing the flow of the blowby gas from a gas inlet port towards a gas outlet port; a separation mechanism, provided midway along the gas flow passage, for separating the oil (oil in the form of mist) from within the blowby gas flowing inside the gas flow passage; an oil passage, having at least a part shared with a part of the gas flow passage that is located downstream of the separation mechanism, in the blowby gas flowing direction, for causing the oil that has been separated (oil that has been separated, condensed and formed into droplets) to flow along a bottom positioned below; and an oil discharge port, provided at a downstream side end section, in the oil flowing direction, of the oil passage, for discharging the oil (oil in the form of droplets) flowing inside the oil passage to the outside of the oil passage, as disclosed in, for example, JP-A-2000-45750. A similar oil separator is also disclosed in JP-A-2004-204811.

In an oil separator having this type of configuration, in the separation mechanism, the oil that has been separated from the blowby gas and formed into the droplets is not accumulated inside the common flow path section formed as a common section to the oil passage and the gas flow passage, but instead swept away towards the oil discharge port side by the flow of the blowby gas on a bottom of the common flow path section so as to be discharged reliably from the oil discharge port to the outside of the oil passage.

However, after investigation by the present inventors with respect to oil flow that stays inside the conventional oil separators as described above, it has been established that there are cases where if there is a large amount of the blowby gas flowing inside the gas flow passage and the flow rate increases, the oil that is separated in the separation mechanism and formed into the droplets is largely blown off the inside of the common flow path section by the blowby gas, and thereby dispersed again or made to flow in an entrained manner, so that some of the oil is not discharged from the oil discharge port but carried away by the blowby gas and discharged together with the blowby gas from the gas exhaust outlet. That is, with the conventional oil separator, it is understood that there may be caused variations in separation characteristics of the oil depending on intake amount of the blowby gas.

SUMMARY OF THE INVENTION

The present invention has been conceived with the above described situation as background, and it is therefore an object of the invention to provide an improved oil separator for a blowby gas in which all oil separated from the blowby gas is discharged to the outside of the oil passage through an oil discharge port regardless of an intake amount of the blowby gas from a gas intake port, thus exhibiting excellent oil separation characteristics in a stable manner.

In an attempt to achieve the object, the principle of the invention is to provide an oil separator for a blowby gas containing oil, comprising:

- a gas flow passage, provided with a gas inlet port and a gas outlet port for the blowby gas, for allowing a flow of the blowby gas from the gas inlet port towards the gas outlet port;
- separation means, provided midway along the gas flow passage, for separating the oil from within the blowby gas which flows inside the gas flow passage;
- an oil passage, at least a part of which is formed as a common flow path section located downstream of the separation means in the blowby gas flowing direction and shared by the gas flow passage, for allowing the oil separated by the separation means to flow along a bottom of the common flow path section; and
- an oil discharge port, provided at a downstream side section, in the oil flowing direction, of the oil passage, for discharging the oil which flows inside the oil passage to the outside of the oil passage, wherein
- a flow passage regulating means is provided in the common flow path section so as to extend upwards from the bottom of the common flow path section, and wherein
- the flow passage regulating means makes a part of the common flow path section a restricted portion, by regulating a width of the part of the common flow path section so that the width becomes gradually narrower towards the bottom of the common flow path section.

Specifically, with the oil separator for the blowby gas according to the present invention, when the blowby gas from which the oil has been separated in the separation means passes through the restricted section of the common flow path section, the flow becomes hindered to a greater extent in the flow passage regulating section as it gets closer to the bottom of the common flow path section. Therefore, an amount of flowing of the blowby gas passing through the restricted section becomes less, as it gets closer to the bottom of the common flow path section, and as a result the flow rate of the blowby gas after having passed through the restricted section is made slower at the bottom of than at the upper part of the common flow path section.

According to the above arrangement, in this type of blowby gas oil separator, there can be advantageously restricted a flow rate of the blowby gas to a low rate, even when a lot of the blowby gas is introduced into the gas flow passage and is flowed in the gas flow passage at a high velocity. As a result, there can be minimized an occurrence of a problem that the oil, which is flowing at the bottom of the common flow path section and is supposed to be discharged from the oil discharge port, is discharged from the gas outlet port together with the blowby gas, because of being blown-off by the blowby gas, and being re-dispersed or entrained in the blowby gas.

Accordingly, in this type of blowby gas oil separator according to the present invention, all the oil separated from within the blowby gas is advantageously discharged from the oil discharge port regardless of the intake amount of the blowby gas from a gas intake port, and as a result, excellent oil separation characteristics are exhibited with high reliability and in a stable manner.

EMBODIMENTS OF THE INVENTION

The present invention is preferably practiced in at least the following features.

(1) An oil separator for a blowby gas containing oil, comprising a gas flow passage, provided with a gas inlet port and a gas outlet port for the blowby gas, for allowing a flow of the blowby gas from the gas inlet port towards the gas outlet port;

separation means, provided midway along the gas flow passage, for separating the oil from within the blowby gas which flows inside the gas flow passage;

an oil passage, at least a part of which is formed as a common flow path section located downstream of the separation means in the blowby gas flowing direction and shared by the gas flow passage, for allowing the oil separated by the separation means to flow along a bottom of the common flow path section; and an oil discharge port, provided at a downstream side section, in the oil flowing direction, of the oil passage, for discharging the oil which flows inside the oil passage to the outside of the oil passage, wherein a flow passage regulating means is provided in the common flow path section so as to extend upwards from the bottom of the common flow path section, and wherein the flow passage regulating means makes a part of the common flow path section a restricted portion, by regulating a width of the part of the common flow path section so that the width becomes gradually narrower towards the bottom of the common flow path section.

(2) The oil separator according to the above feature (1), wherein the oil discharge port and the gas outlet port are respectively provided at different positions in the width direction of the common flow path section, and a part of the restricted portion of the common flow path section which has a minimum width is arranged to be positioned towards a side of the common flow path section, in the width direction, where the oil discharge port is provided. According to this feature, the oil that has passed through the section, which has the minimum width of the restricted section, is caused to flow on a bottom of the common flow path section that is located downstream of the restricted section at a side that is closer to the oil discharge port, of the gas outlet port and the oil discharge port, which are separated from each other in the width direction of the common flow path section. Accordingly, together with the effect of preventing the oil from being carried away by the blowby gas, the oil can be more effectively prevented from being discharged from the gas outlet port. As a result, an excellent oil separation performance is exhibited in a much more stable manner.

(3) The oil separator according to the above feature (2), wherein the oil passage has:

a bottom connected to the bottom of the common flow path section, where the restricted portion has the minimum width; and an oil passage downstream section which extends towards the downstream of the common flow path section in the oil flowing direction, and wherein the gas flow passage has a gas flow passage downstream section which is located downstream of the common flow path section in the blowby gas flowing direction, extending in a direction which is different from the extending direction of the oil passage section.

According to this feature, the oil that has been passed through the minimum width section of the restricted section is smoothly guided into the oil passage downstream section, and caused to flow inside the oil passage downstream section, and as a result is advantageously discharged from the oil discharge port. Also, as the gas flow passage downstream section extends in a different direction to the oil passage downstream section, the oil discharge port is advantageously located away from the gas outlet port, whereby the oil can be effectively prevented from being discharged from the gas outlet port.

(4) The oil separator according to the above feature (3), wherein the gas flow passage downstream section extends in a direction that is opposite from the extending direction of the oil passage downstream section. According to this feature, the oil discharge port is located more sufficiently away from the gas outlet port, whereby the oil can be more effectively prevented from being discharged from the gas outlet port.

(5) The oil separator according to any one of the above features (1) to (4), wherein the flow passage regulating means is formed from at least one plate-shaped rib stood so as to extend integrally upwards from the bottom of the common flow path section, at a mid point of the common flow path section, at one surface in the width direction, so that the flow of the blowby gas inside the common flow passage is partially blocked, and the at least one plate-shaped rib has a gradually increasing section, of which a width gradually increases towards the bottom of the common flow path section to restrict the width of the restricted portion of the common flow path section, so that the width of the restricted portion becomes gradually narrower towards the bottom of the common flow path section. According to this feature, within the common flow path section, the size of the locations where the flow restriction section is arranged, namely the section occupied by the restricted section, is made as small as possible. There can be advantageously avoided an extension of the length of the common flow path section caused by the arrangement or installation of the restricted section, whereby unnecessary enlargements of overall the oil separator can be advantageously avoided.

(6) The oil separator according to the above feature (5), wherein an upper region of the at least one plate-shaped rib is constituted by the gradually increasing section, and a lower region of the plate-shaped rib is constituted by a wide-width section which has a width wider than the maximum width of the gradually increasing section and is narrower than the width of the common flow path section. According to this feature, it is possible to make the thickness of the section constituting the minimum width of the restricted section smaller, without particularly changing the amount of gradual increase of the gradually increasing section. Accordingly, for example, particularly in the case of adopting this aspect in the above described feature (5), which is a combination of the feature (2) and the feature (3), the oil that has passed through the section constituting the minimum width of the restricted section is made to flow at a downstream side of the bottom of the common flow path section that is further away from the gas outlet port than the restricted section of the common flow path section, in the width direction of the common flow path section. In this way, discharge of the oil from the gas outlet port is more effectively prevented, and the oil separation performance is exhibited with an extra degree of stability.

(7) The oil separator according to any one of the above features (1) to (6), wherein the gas flow path extends to make a U-turn. According to this feature, it becomes possible to make the length of the gas flow passage as long as possible without increasing the overall length of the oil separator.

(8) The oil separator according to any one of the above features (1) to (7), wherein the gas flow passage has an expanded section, of which a cross sectional surface area is enlarged, and the expanded section is provided downstream of the flow passage regulating means of the gas flow passage in the blowby gas flowing direction. According to this feature, in the expanded section it is possible to rapidly reduce the flow rate of the blowby gas, and in this way also the discharge of the oil from the gas outlet port due to being carried away by the blowby gas can be advantageously prevented.

BRIEF DESCRIPTION OF THE DRAWINGS

The above and other objects, features, advantages and technical and industrial significance of the present invention will be better understood by reading the following detailed description of presently preferred embodiments of the invention, when considered in connection with the accompanying drawings, in which.

DESCRIPTION OF PREFERRED EMBODIMENTS

Figure 1:
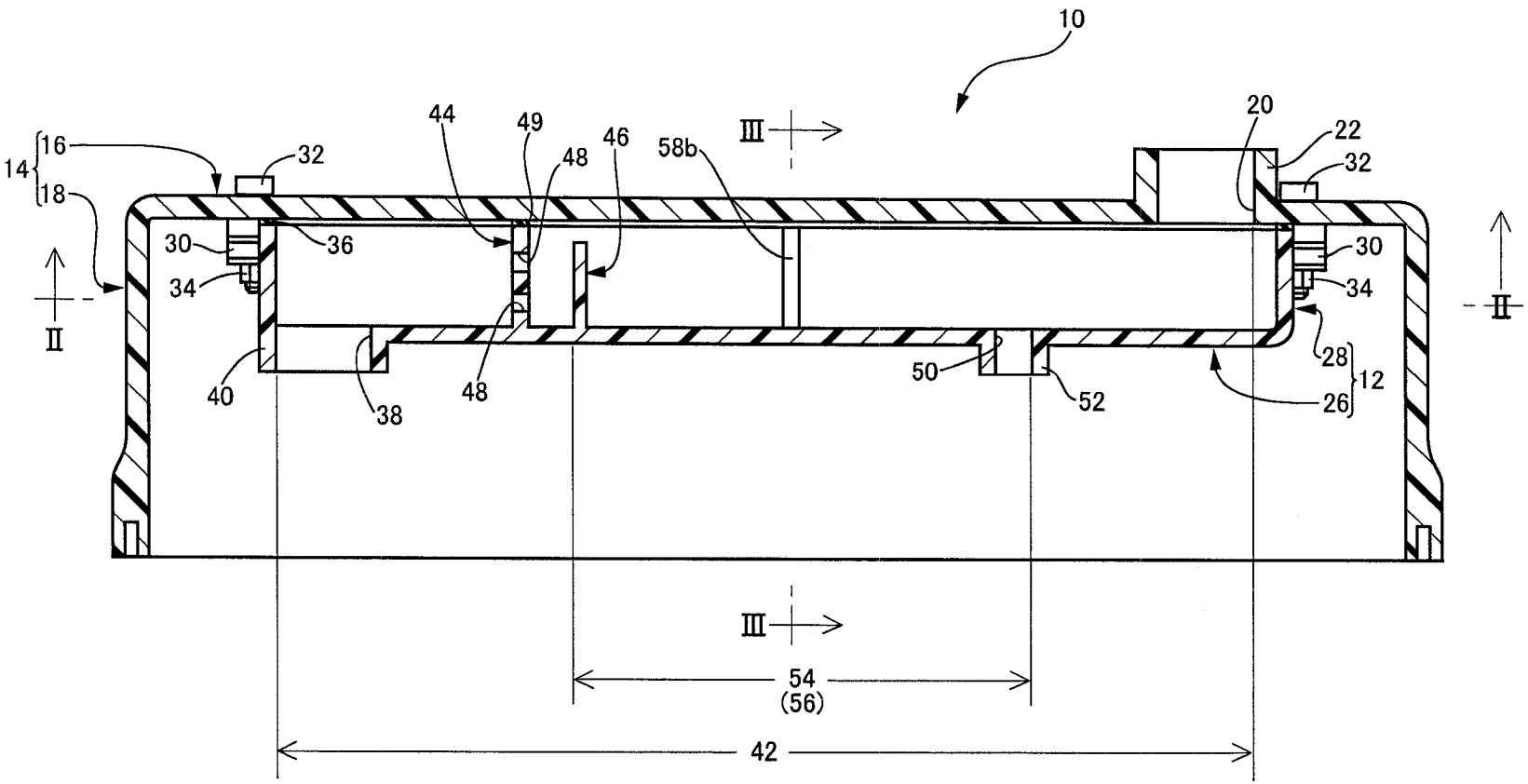
FIG. 1 is a cross sectional explanatory view showing one embodiment of an oil separator for blowby gas according to the present invention, corresponding to a cross sectional view being taken along line I-I in FIG. 2.
Figure 2:
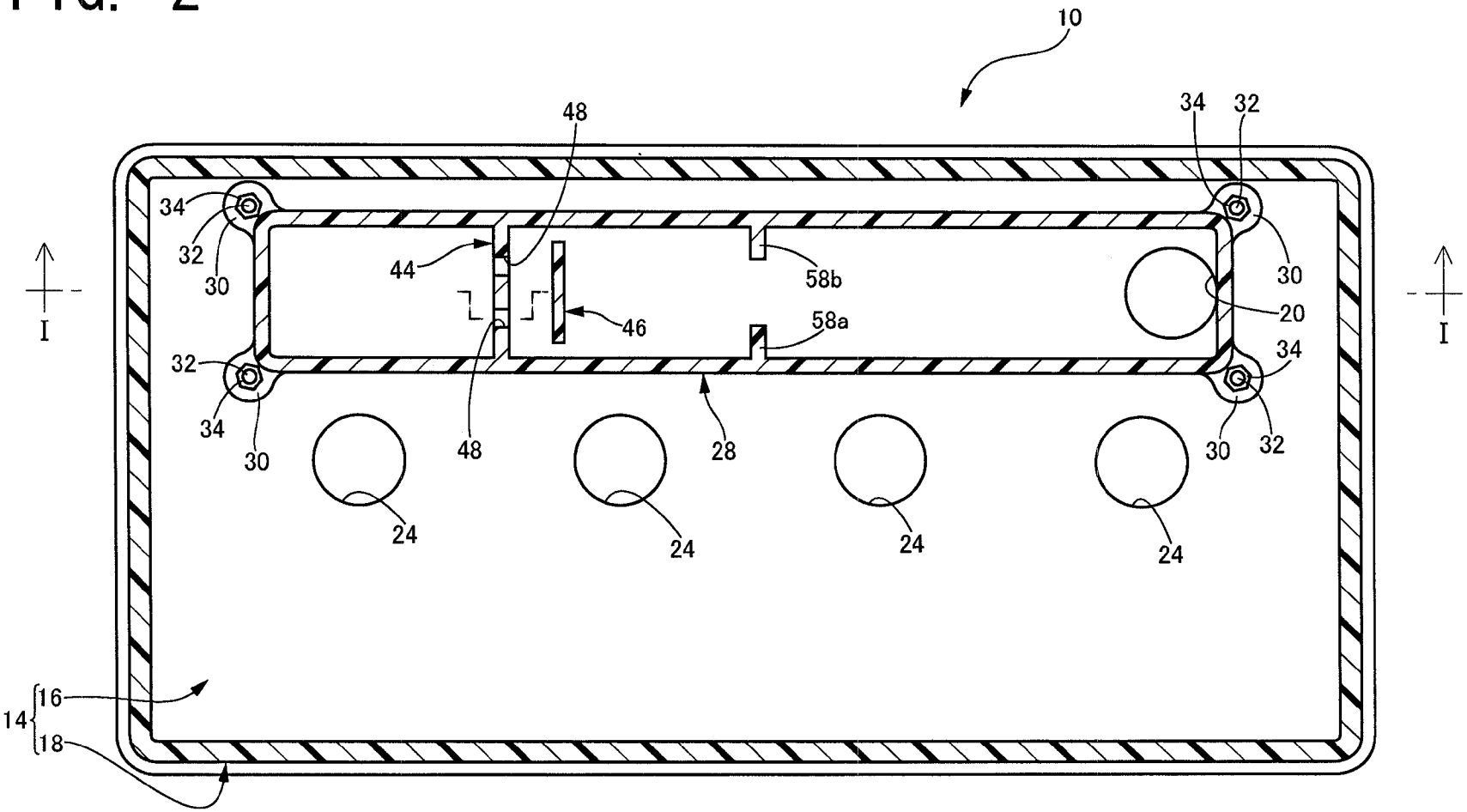
FIG. 2 is a cross sectional explanatory view being taken along line II-II in FIG. 1.

First of all, as one embodiment of an oil separator for blowby gas according to the present invention, a vertical cross section and a horizontal cross section of an oil separator constructed by fitting to a cylinder head cover of a vehicle engine are respectively schematically shown in FIG. 1 and FIG. 2. As will be clear from FIG. 1 and FIG. 2, the oil separator 10 of this embodiment is constructed with a casing 12, provided with an upper side open section, covered by a cylinder head cover 14.

More specifically, the cylinder head cover 14 covering the casing 12 as a separator body is made up of an injection molded component using glass fiber reinforced plastic resin with a matrix of a polyamide resin, for example. The cylinder head cover 14 has a substantially longitudinally rectangular plate-shaped top plate section 16, and a longitudinally rectangular frame shaped part 18, integrally spanning across the entire outer periphery of the lower surface (rear surface) of the top plate section 16, and overall has a longitudinally rectangular case shape.

Also, a gas outlet port 20 having a circular shape for discharging the blowby gas that has been introduced inside the casing 12 covered by the cylinder head cover 14, as will be described later, is provided in the top plate section 16 of the cylinder head cover 14 at a location offset to one side from the center in a width direction (in FIG. 2, a lateral direction) of one end in the longitudinal direction (a right and left direction in FIG. 2), passing through the top plate section 16. Further, a cylindrical collar section 22 of comparatively low height is integrally formed at a rim section of the outer opening section of this gas outlet port 20.

Although not shown in FIG. 1 and FIG. 2, this cylinder head cover 14 is attached to a cylinder head using a bolt fastening, similarly to the related art, for example, at leg sections 18. Also, in a state attached to the cylinder head, by connecting connector pipes extending from the intake piping to the collar section 22, the gas outlet port 20 is connected to and communicated with the intake piping via the connector pipes. In FIG. 2, reference numeral 24 represents through holes for insertion of plug tubes.

Meanwhile, the casing 12 has a bottom 26 presenting a longitudinally rectangular flat plate shape that is smaller than the top plate section 16 of the cylinder head cover 14, and a side wall section 28 fully spanning the outer rim of the upper surface of the bottom 26 and presenting a longitudinally rectangular frame shape, and overall is formed in a longitudinally rectangular case shape smaller than the cylinder head cover 14. This casing 12 is also formed from an injection-molded component using the glass fiber reinforced resin material which is the same as the material of the cylinder head cover 14.

Also, attachment brackets 30 are respectively integrally formed at the respective upper end sections at the four corners of the side wall section 28 of the casing 12, one in each corner. Then, with the casing 12, at one end in the longitudinal direction, having an upper end surface of the side wall section 28 confronting the lower surface of the top plate section 16, and positioned so as to be aligned with the gas outlet port 20 provided in the top plate section 16 of the cylinder head cover 14 and have the upper opening section covered by the top plate section 16, four fastening bolts 32 inserted through the top plate section 16 are inserted into respective attachment flanges 30 of the casing 12, and nuts 34 are screwed onto the ends of each of the fastening bolts 32. In this way, the casing 12 is fixed to the lower surface of the top plate section 16 of the cylinder head cover 14. Also, in this fixed state, by interposing a sealing rubber 36 between the upper end surface of the side wall section 28 and the lower surface of the top plate section 16, an air-tight seal is formed between the upper end surface of the side wall section 28 and the lower surface of the top plate section 16.

Further, a gas inlet 38 having a circular shape of almost the same diameter as the gas outlet port 20 provided in the top plate section 16 of the cylinder head cover 14 is provided in the bottom 26 of the casing 12, at a central part in the width direction (i.e., a vertical direction as seen in the plane of FIG. 1) of one end in the longitudinal direction of the casing 12 (the right and left direction in FIG. 1), passing through the bottom 26. Also, a cylindrical collar section 40 of comparatively low height is integrally formed at a rim section of the outer opening section of the gas inlet 38 of the bottom 26.

Therefore, in the oil separator 10 of this embodiment, together with the cylinder head cover 14 being attached to a cylinder head, not shown in the drawings, by making the gas outlet port 20 provided in the top plate section 16 of the cylinder head cover 14 communicate with not illustrated intake piping, based on negative pressure inside the intake piping, the blowby gas inside a crankcase (not shown) passes through the gas inlet 38 and is introduced to the inner part of the oil separator 10 (the casing 12), caused to flow towards the gas outlet port 20, and then discharged from the gas outlet port 20 so as to flow inside the intake path. That is, the entire space inside the casing 12 is made a gas flow passage 42 for flowing the blowby gas.

Also, at a location offset to a specified extent to the side where the gas outlet port is formed, from the center of the bottom 26 of the casing 12 in the longitudinal direction, in other words at a location at an upstream side in the flowing direction of the blowby gas in the gas flow passage 42, a baffle plate 44 and an impingement (or collision) plate 46 face each other keeping a specified distance therebetween, with the baffle plate 44 being positioned to the gas inlet port 38 side, so that the flow of the blowby gas is blocked by one surface of each of the baffle plate 44 and the impingement plate 46 in a thickness direction.

Specifically, the baffle plate 44 is formed from a flat plate which has a width that is the same as the width of the bottom 26 of the casing 12 and has a height that is the same as the height of the side wall section 28, and respectively integrated with the bottom 26 and the side wall section 28 at a lower end section and both side sections. Also, at respective intermediate sections in the width direction and the height direction, a plurality (four in this case) of small diameter through holes 48 are formed. Further, sealing rubber 49 is interposed between the upper surface of the baffle plate 44 and the lower surface of the top plate section 16 of the cylinder head cover 14. In this way, the gas flow passage 42 inside the casing 12 is partitioned into two, namely an upstream section and a downstream section in the blowby gas flowing direction, by the baffle plate 44, and the upstream section and the downstream section are respectively connected by only the plurality of through holes 48 provided in the baffle plate 44.

Meanwhile, compared to the baffle plate 44, the impingement plate 46 positioned opposing the gas outlet port 20 side is formed from a rectangular flat plate having a width that is a specified dimension smaller than the width of the bottom 26 of the casing 12, and a height that is a specified dimension lower than the height of the side wall section 28. The impingement plate 46 is integrally stood on the bottom 26 in such a state that together with forming a three-sided square-shaped gap between the lower surface of the top plate section 16 of the cylinder head cover 14 and the inner surface of the side wall section 28, the plurality of through holes 48 provided in the baffle plate 44 are positioned so as to be covered and hidden from the gas outlet port 20 side.

Further, an oil discharge port 50 is formed at a location offset a specified distance to the gas outlet port 20 side from the center, in the length direction, of the bottom 26 of the casing 12, in other words, at a location further downstream in the direction of the flow of blowby gas in the gas flow passage 42, and further upstream than the gas outlet port 20. This oil discharge port 50 has a circular shape with a diameter smaller than the gas outlet port 20 and gas inlet 38, and is provided passing through the bottom 26. Also, a cylindrical collar section 52 of comparatively low height is integrally formed at a rim section of the outer opening section of the oil discharge port 50 of the bottom 26.

Thus, with the oil separator 10 of this embodiment, the blowby gas that has been introduced into the inside of the casing 12 (gas flow passage 42) from the gas inlet 38 passes from the section of the gas flow passage 42 further upstream than the baffle plate 44 through only the plurality of through holes 48 in the baffle plate 44, and is introduced to a section downstream of the baffle plate 44, and flows from the inside the downstream section towards the gas outlet port 20. Also, with the flow of the blowby gas inside the gas flow passage 42 in this manner, as a result of the blowby gas being passed through the small diameter through holes 48 in the baffle plate 44, the flow rate is increased and the blowby gas also impinges on the impingement plate 46, and at this time the oil mist within the blowby gas becomes adhered to the opposing surfaces of the baffle plate 44 and the impingement plate 46, and further, the oil mist that has become adhered to the opposing surfaces is condensed and formed into droplets. Specifically, by using a so-called inertial impaction method, oil mist is separated from within the blowby gas, and droplets of oil are formed. The droplets of the oil then are swept by the flow of blowby gas along the bottom 26 of the casing 12 to the oil discharge port 50 side, and returned again from the oil discharge port 50 to the inside of the crankcase.

As will be clear from this fact, here the separation means for separating the oil is constituted by the baffle plate 44 and the impingement plate 46. Also, a section of the internal space of the casing 12 from the arrangement location of the impingement plate 46 to the formation location of the oil discharge port 50 constitutes an oil passage 54 in which the oil droplets are made to flow, and the whole of this oil passage 54 is made a common flow path section 56 that is shared with a downstream section of the gas flow passage 42.

Figure 3:
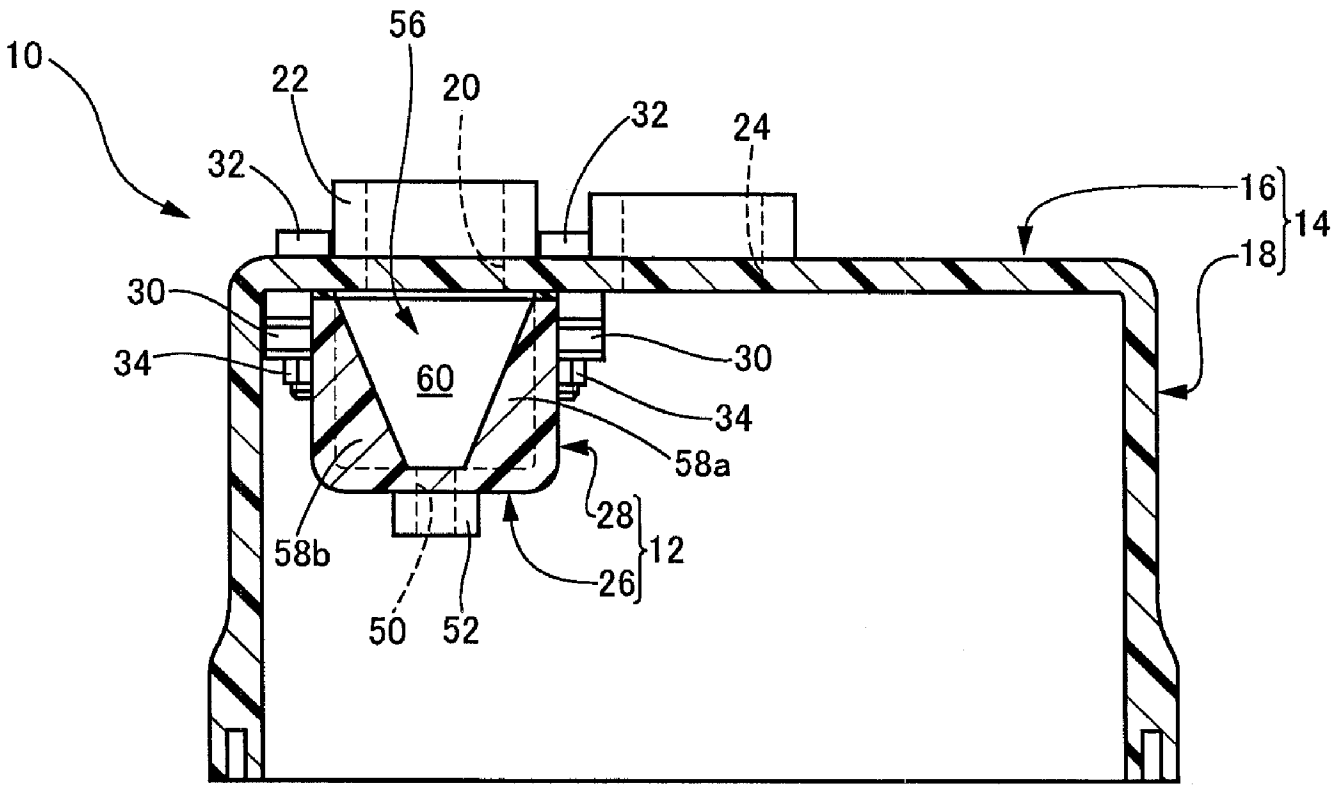
FIG. 3 is a cross sectional explanatory view being taken along line III-III in FIG. 1.

Accordingly, as will be clear from FIG. 1 and FIG. 3, with the oil separator 10 relating to this embodiment, in particular, at a substantially central section of the bottom 26 of the casing 12 in the length direction, namely, a middle part of the common flow path section 56, a pair of plate-shaped ribs 58*a*, 58*b* are respectively integrally formed in a state laterally aligned in the width direction of the common flow passage 56 and positioned opposite to the impingement plate 46.

In more detail, the pair of plate-shaped ribs 58*a*, 58*b* are both formed from plates provided with a thickness that is the same as that of the bottom 26 of the casing 12 and the side wall section 28. Also, each of these plate-shaped ribs 58 has an overall shape that is a right-angled triangle provided with a bottom side having a length that is shorter than half the width of the bottom 26 by a specified extent, and an opposite side (the side constituting the right angle with the bottom side) having a height that is almost the same as the height of the side wall section 28. The plate-shaped rib sections 58*a*, 58*b* have the bottom sides integrally formed with the bottom 26 of the casing 12 and the opposite sides integrally formed with the side wall sections 28 of the casing 12, at positions respectively offset to the left and right sides from the center, in the width direction, of the middle part of the common flow path section 56, and further, inclined edge sections are provided so as to extend upwards from the bottom 26 in a state offset to the left and right sides from the center in the width direction of the common flow path section 56.

In other words, the plate-shaped rib 58*a* positioned offset to the right side in the central location of the common flow section 56 has a shape gradually increasing in width to the left side towards the bottom 26, and at a surface opposite to the impingement plate 46 is positioned so as to partially block the flow of the blowby gas in the right half of the middle part of the common flow section. Similarly, the plate-shaped rib 58*b* positioned offset to the left side in the central location of the common flow section 56 has a shape gradually increasing in width to the right side towards the bottom 26, and at a surface opposite to the impingement plate 46 is positioned so as to partially block the flow of the blowby gas in the left half of the middle part of the common flow path section 56.

This means that with the oil separator 10 of this embodiment, the thickness of the middle part of the common flow section 56 is regulated so as to become gradually smaller towards the bottom 26 by the pair of plate-shaped ribs 58*a*, 58*b*, and as a result the central section of the common flow path section 56 is made into a restricted section 60, of which a cross section has a trapezoidal shape with a lower side that is smaller than the upper side. As will be clear from this, the pair of plate-shaped ribs 58*a* and 58*b* here constitute a flow regulating section. Also, each of the plate-shaped ribs 58 overall constitutes a gradually increasing section.

Accordingly, with the oil separator 10 having this type of structure, when the blowby gas from which the oil has been separated by the baffle plate 44 and the impingement plate 46 passes through the restricted section 60 of the common flow path section 56, the flow of the blowby gas is more significantly disturbed by the pair of plate-shaped ribs 58*a* and 58*b* as a position in the constricted section 60 gets closer to the bottom 26, and the flow amount of the blowby gas passing through the restricted section is reduced as a position in the constricted section 60 gets closer to the bottom 26.

Also, in this way, for example, even if a large amount of the blow by gas is introduced from the gas inlet 38 in a short time and the flow rate of the blowby gas inside the gas flow passage 42 is high, causing the blowby gas from which the oil has been separated to flow in the restricted section 60, the flow rate of the blowby gas flowing in a section of the common flow path section 56 further downstream than the restricted section 60 is advantageously kept low at the bottom 26 side. As a result, there can be minimized an occurrence of a problem that the oil, which is flowing at the bottom of the common flow path section and is supposed to be discharged from the oil discharge port 50, is discharged from the gas outlet port 20 together with the blowby gas, because of being blown-off by the blowby gas, and being re-dispersed or entrained in the blowby gas.

Accordingly, in the oil separator 10 of this embodiment, provides excellent oil separation performance that is stably exhibited with high reliability, regardless of the intake amount of the blowby gas from the gas inlet 38.

In this oil separator 10, the gas outlet port 20 is provided at the top plate section 16 of the cylinder head cover 14 that covers the casing 12, and is positioned on an upper part opposite to the bottom 26 side forming the oil discharge port 50, and in this way also, there can be advantageously prevented the oil droplets flowed on the bottom 26 from being discharged through the gas outlet port 20.

Further, with this embodiment, the gas outlet port 20 is provided at a more downstream side, in the flowing direction of blowby gas, than the oil discharge port 50, which means that there is an advantage that the oil droplets that have been separated from within the blowby gas are reliably washed away on the bottom 26 of the casing 12 by the flow of the blowby gas, and reliably made to reach the oil discharge port 50.

Still further, in the oil separator 10 of this embodiment, since the pair of plate-shaped ribs 58*a*, 58*b* are provided at a middle part of the common flow path section 56 to form the restricted section 60, the length of the restricted section 60 in the flowing direction of the blowby gas can be effectively shortened. As a result, there can be advantageously avoided the restricted section 60 being unnecessarily long and the common flow path section being lengthened to that extent and thus increasing the overall size of the oil separator 10.

Figure 4:
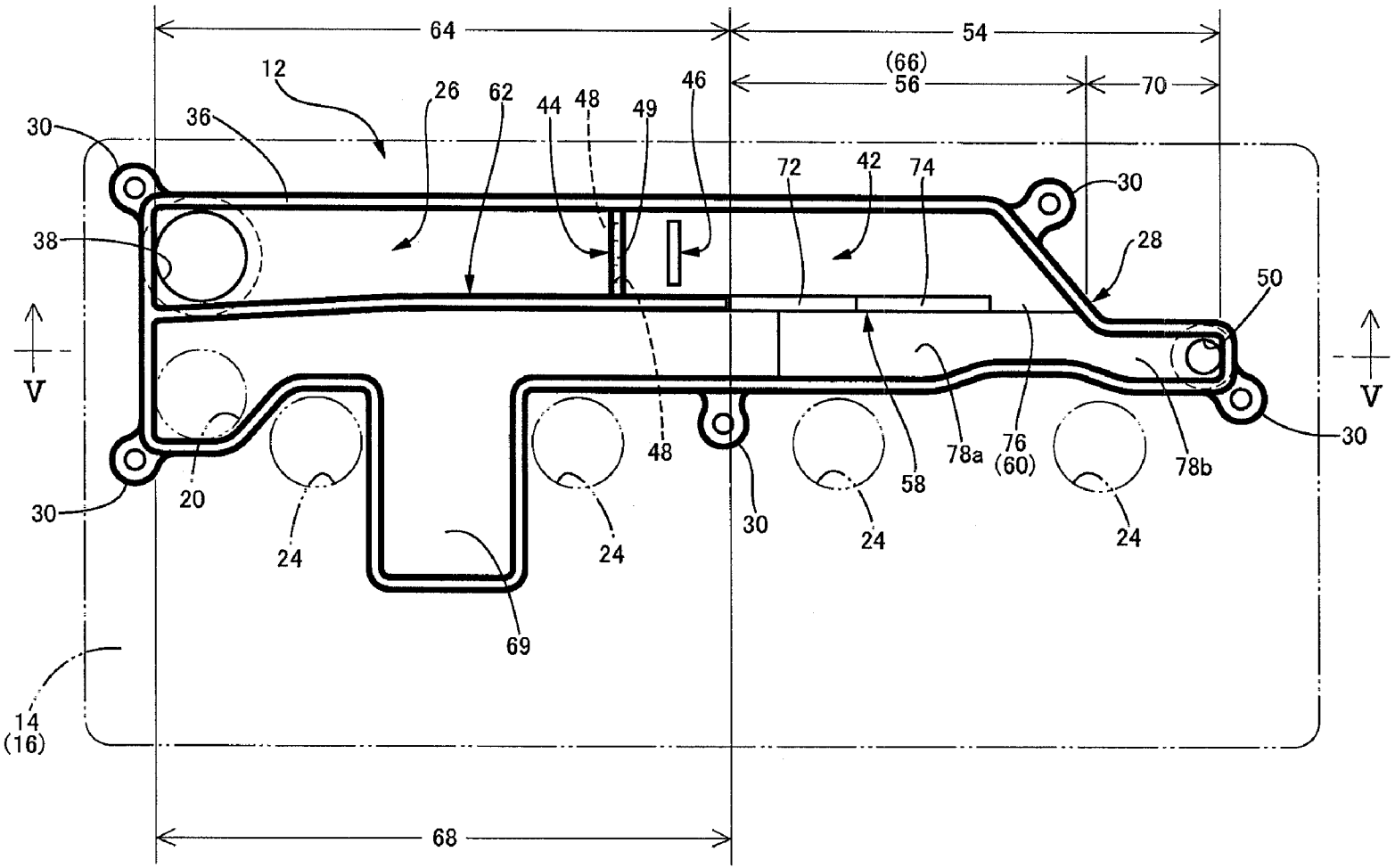
FIG. 4 is a plan explanatory view showing a casing constituting another embodiment of an oil separator for blowby gas according to the present invention.
Figure 5:
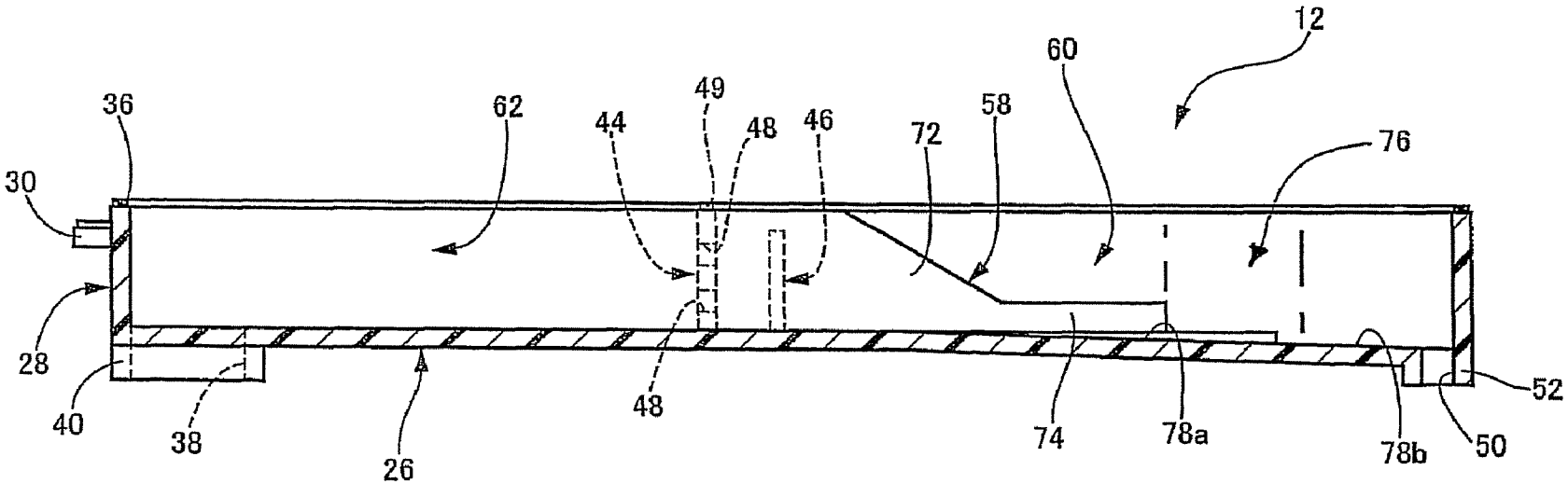
FIG. 5 is a cross sectional explanatory view being taken along line V-V in FIG. 4.

Next, another embodiment which has a partially different structure to the above described embodiment is shown in FIG. 4 and FIG. 5. The embodiment described in detail in the following is different from the above-described first embodiment in the structure of the casing 12. Therefore, within the oil separator of this embodiment, only parts of the casing 12 that clearly specify the structure of the casing 12 are shown in FIG. 4 and FIG. 5. Also, in the embodiment partially shown in FIG. 4 and FIG. 5, and the embodiment shown in FIG. 6 that will be described later, members and parts that have the same structure as the embodiment shown in FIG. 1 to FIG. 3 have the same reference numerals as in FIG. 1 to FIG. 3, and their detailed description will be omitted.

Specifically, the oil separator of this embodiment is formed overall having a casing 12 provided with a bottom 26 presenting a substantially longitudinally rectangular shape, and a side wall section 28 fully spanning the outer rim of the upper surface of the bottom 26 and presenting a longitudinally rectangular frame shape. This casing 12 is formed from an injection molded component using a glass reinforced fiber resin material which is the same as the material of the cylinder head cover 14 (shown by the two-dot chain line in FIG. 4).

In the casing 12, a gas inlet 38 which has a large diameter circular though hole is provided in one end at one side (the left side in FIG. 4) in a longitudinal direction (a right and left direction in FIG. 4) of the bottom 26, at a section that is offset to one side (upper side in FIG. 4) from the center in the width direction (a vertical direction in FIG. 4). Meanwhile, as shown by the two-dot chain line in FIG. 4, a gas outlet port 20 (shown by the two-dot chain line in FIG. 4) which has a form of a circular through hole that is the same as the gas inlet 38 is formed in the top plate section 16 of the cylinder head cover 14 so as to be positioned next to the gas inlet 38 in the width direction of the casing 12, with the casing 12 attached to the top plate section 16.

Also, a partitioning rib 62 which partitions an internal space of the casing 12 into two sections in the width direction, and has a height and thickness the same as those of the side wall sections 28, is integrally formed in a substantially central part, in the width direction, of the bottom 26 of the casing 12. This partitioning plate rib 62 has a length, from a gas inlet 38 side end section to the central section, in the length direction of the bottom 26, and extends continuously. In this manner, a part of the bottom 26 in which the gas inlet 38 is provided and a part of the bottom 26 corresponding to the gas outlet port 20 provided in the top plate section 16 of the cylinder head cover 14 are positioned on either side of the partitioning rib 62 in the width direction.

Therefore, within the internal space of the casing 12, a gas flow upstream side section 64 is formed in a section between the partitioning rib 62 and a part of the side wall section 28 opposite to the partitioning rib 62 on the other side of the gas inlet 38, and a gas flow passage mid-flow section 66 is formed in another section, in the length direction of the casing 12, where the partitioning rib 62 is not formed, and further a gas flow downstream side section 68 is formed in a section between the partitioning rib 62 and the side wall 28 section opposite to the partitioning rib 62 that is on the other side of the section corresponding to the gas outlet port 20.

In this way, the blowby gas that has been introduced from the gas inlet 38 enters the gas flow passage mid-flow section 66 from the gas flow upstream side section 64, has its flow direction reversed there by colliding with the side wall 28 section extending to surround the gas flow passage mid-flow section 66, and enters the gas flow downstream side section 68. Then, the blowby gas that has entered the gas flow downstream side section 68 flows in the gas flow downstream side section 68 in a direction that is opposite to the flow direction in the gas flow upstream side section 64, is discharged through the gas outlet port 20 provided in the top plate section 16 of the cylinder head cover 14 so as to be positioned at an end section of the gas flow downstream side section 68, and further flows inside the intake piping, not shown in the drawing. That is, with this embodiment the gas flow passage 42 is made up of substantially the entire internal space of the casing 12, and is formed so as to extend to make a U-turn.

Mid way along the gas flow downstream side section 68, a expanded section 69 is formed where part of the bottom 26 projects sideways, and where a cross sectional area of the gas flow downstream side section 68 is partially increased. In this way, the flow rate of the blowby gas flowing inside the gas flow downstream side section 68 is reduced in the expanded section 69.

Meanwhile, in the gas flow passage 42, the baffle plate 44 and the impingement plate 46 having the same structure as in the above described first embodiment are stood on the bottom 26, at a section close to the gas flow passage mid-flow section 66 of the gas flow upstream section 64. In this way, the oil mist within the blowby gas that is introduced from the gas inlet 38 into the gas flow passage 42 is separated from within the blowby gas based on an inertia collision effect of the baffle plate 44 and the impingement plate 46, and formed into the droplets. These oil droplets are swept in the flowing direction by the blowby gas flow above the bottom 26 of the gas flow passage mid-flow section 66.

Also, a flow path of narrow width extending in the length direction of the casing 12 is provided in a section of the gas flow passage mid-flow section 66 that is distant from the gas flow upstream section 64, offset to an opposite side to the gas intake 38 side in the width direction of the casing 12. Further, the bottom 26 of the narrow width passage is connected with the bottom 26 of the gas flow passage mid-flow section 66, and an oil discharge port 50 is formed to have a small diameter circular through hole shape in an end of the bottom 26 opposite to the gas flow passage mid-flow section 66 side.

Therefore, the oil passage 54 is constituted by the gas flow passage mid-flow section 66 and the narrow width passage extending from the gas flow passage mid-flow section 66, and the oil droplets flowing on the bottom 26 of the gas flow passage mid-flow section 66 passes through the narrow width passage and is returned to the inside of the crankcase, not shown, from the oil discharge port 50. That is, together with the common flow path section 56 being constituted by an upstream section of the oil passage 54 shared with the gas flow passage mid-flow section 66, the oil passage downstream section 70 is constituted by the narrow width passage extending from the gas flow passage mid-flow section 66 to a side opposite to the gas flow downstream section 68. Also, in this manner the oil passage downstream section 70 extends in a direction that is opposite to the extension direction of the gas flow passage downstream section 68, and the gas outlet port 20 and the oil discharge port 50 are respectively positioned at both ends in the length direction of the casing 12.

In the oil separator of the present embodiment, a plate-shaped rib 58, as a flow passage regulating section, is integrally provided in a middle part of the common flow path section 56 in the flowing direction of the blowby gas and the oil, extending continuously with the partitioning rib 62 so as to extend in the longitudinal direction of the casing 12. In other words, the plate-shaped rib 58 is provided in the middle part of the common flow path section 56 so as to extend in a width direction (the right and left direction in FIG. 4) of the common flow path section 56 and so as to extend integrally upward from the bottom 26, so that the flow of the blowby gas flowing in a direction at right angles to the blowby gas flow direction inside the gas flow upstream section 64 and inside the gas flow downstream section 68 is partially blocked. The section the inside the common flow path section 56 where the plate-shaped rib 58 is arranged constitutes the restricted section 60.

Also, substantially a half section of one side (side continuous to the partitioning rib 62, left side in FIG. 4) in the width direction (the right and left direction in FIG. 4) of the plate-shaped rib 58 has a trapezoidal shape with a height gradually reducing going towards another side in the width direction (the right side in FIG. 4), while the remaining substantially half section has a rectangular shape extending at the same height. That is, substantially a half section of the plate-shaped rib 58 close to the gas flow passage upstream section 64 constitutes a gradually increasing section 72 that gradually increases in width as it goes downward, and a remaining substantially half section close to the oil passage downstream section 70 constitutes a wide width section 74 that is longer than the maximum length section of a lower end of the gradually increasing section 72 and shorter than the length of the common flow path section 56.

In this way, the width of the restricted section 60 of the common flow path section 56 in a section close to the gas flow passage upstream section 64 becomes gradually smaller towards the bottom of the common flow path section, and is regulated by the plate-shaped rib 58 so as to become a maximum width in a section close to the oil flow passage downstream section 70. The minimum width section 76 of the restricted section 60 is positioned to a side in the width direction of the common flow path section 56 where the oil discharge port 50 is arranged.

Also, an upper surface (inner surface) of the bottom 26 of the common flow path section 56 that is located downstream of the plate-shaped rib 58 in the flow direction of the blowby gas is made an inclined surface **78*a* that is inclined downwards going towards the oil flow passage downstream section 70. Thus, the oil droplets that pass through the minimum width section 76 of the restricted section 60, and flow from an upstream side of the common flow path section 56 along the bottom 26 towards the downstream side, run along the inclined section 78*a* and flow smoothly into the oil flow passage downstream section 70. By also making a bottom 26 of the oil flow passage downstream section 70 an inclined section 78*b* that inclines downward going towards the oil discharge port 50, oil droplets that have flowed into the oil flow passage downstream section 70 flow more smoothly towards the oil discharge port 50**.

In this way, with the oil separator of this embodiment, since the width of the restricted section 60 of the common flow path section 56 is regulated so as to become gradually smaller towards the bottom of the common flow path section by the gradually increasing section 72 of the plate-shaped rib 58, when the blowby gas from which the oil has been separated by the baffle plate 44 and the impingement plate 46 passes through the restricted section 60, the flow of the blowby gas is more significantly disturbed by the plate-shaped rib 58 closer to the bottom 26, and the flow amount of the blowby gas passing through the restricted section 60 is reduced as a position on the restricted section gets closer to the bottom 26. As a result of this, there can be effectively prevented the droplets of the oil, which have been separated from the blowby gas, from being carried away by the blowby gas.

Accordingly, with this embodiment also, the operation and effects obtained in the above described first embodiment, namely the high reliability and stable exhibition of an excellent oil separation performance can be effectively obtained regardless of the intake amount of the blowby gas introduced from the gas intake 38.

Also, in the oil separator of this embodiment, since the wide width section 74 having a length longer than the maximum length of the gradually increasing section 72 is provided on the plate-shaped rib 58 that is stood on the restricted section 60 and the wide width section 74 and the minimum width section 76 of the restricted section 60 are positioned side by side inside the restricted section 60 in the width direction, the oil droplets flowing on the bottom 26 of the common flow path section 56 flow along the wide width section 74 towards the minimum width section 76 of the restricted section 60. Therefore, the oil droplets pass from the minimum width section 76 of the restricted section 60 through the oil passage downstream section 70, of which a part of the bottom 26 is continuous to the bottom 26 of the restricted section 60, and are reliably discharged from the oil discharge port 50.

Also, with the oil separator, by having the gas flow passage downstream section 68 and the oil passage downstream section 70 extending in an opposite direction to the length direction of the casing 12 from the common flow path section 56 and providing the minimum width section 76 the restricted section 60 at the oil discharge port 50 side in the width direction of the common flow path section 56, the minimum width section 76 sufficiently closer to the oil discharge port 50 than the gas outlet port 20. Also, the bottom 26 of the oil passage downstream section 70 which has the oil discharge port 50 at an end section and the bottom 26 of the minimum width section 76 are continued with each other. As a result of this also, there can be more reliably discharged almost all of the oil droplets, which have been separated from the blowby gas, through the oil discharge port 50.

Moreover, in this embodiment, since an upper surface of the bottom 26 of the common flow path section 56, which is located downstream of the plate-shaped rib 58 in the flow direction of the blowby gas, is made an inclined surface 78*a* that is inclined downwards going towards the oil flow passage downstream section 70, the oil droplets that have been prevented from flowing directly to the oil flow passage downstream section 70 from the minimum width section 76 of the restricted section 60 by the flow of the blowby gas is also advantageously prevented by the inclined section 78*a* from flowing to the gas flow passage downstream section 68, and it becomes possible for the oil droplets to pass through the oil flow passage downstream section 70 and be discharged from the oil discharge port 50.

Further, in the oil separator of this embodiment, since the gas flow passage 42 is formed so as to extend to make a U-turn, the length of the gas flow passage 42 is made as long as possible with respect to the casing 12 having a limited overall length.

Still further, in the oil separator, since the flow rate of the blowby gas is reduced in the jutting section 69 provided midway along the gas flow passage downstream section 68, the droplets of the oil that are blown off or entrained in the blowby gas and penetrate into the gas flow passage downstream section 68 are released from the blowby gas at the jutting section 69, and discharge of these oil droplets from the gas outlet port 20 can be effectively controlled.

Experiments performed by the present inventors in order to confirm that the oil separator of this type of embodiment exhibits the above-described characteristics will now be described in detail.

Specifically, first of all a casing having the structure as shown in FIG. 4 and FIG. 5 was manufactured, and by attaching this casing to a separately manufactured cylinder head cover, whereby the oil separator was constructed. This oil separator was made as Test product 1. The casing and the cylinder head cover constituting the oil separator of this Test product 1 were respectively manufactured by injection molding by using a glass fiber reinforced resin material with a matrix of a polyamide resin. Also, a plate-shaped rib provided on an upper part of the bottom of the common flow path section was made to have a thickness of 2.0 mm, a maximum height of 20 mm and a minimum height of 3 mm. Further, the width of the gradually increasing section of the plate-shaped rib was 40 mm, and the inclination angle of the upper surface of the gradually increasing section was a downward inclination of 30 degrees from the upper end surface of the partitioning rib.

For the purposes of comparison, a casing having the same structure as the structure shown in FIG. 4 and FIG. 5 but not provided with the plate-shaped rib was also manufactured. Also, this casing was attached to a cylinder head cover, which is the same as the cylinder head cover used with the oil separator of Test product 1, to manufacture an oil separator having the same structure as that of the related art without the plate-shaped rib, and this was made as Test product 2. The casing and the cylinder head cover constituting the oil separator of this Test product 2 were respectively manufactured by injection molding using the glass fiber reinforced resin with the matrix of the polyamide resin. Also, the thickness of a partitioning rib which partitions the gas flow passage upstream section and the gas flow passage downstream section was 2.0 mm, and the height was 20 mm.

Next, the blowby gas was introduced into the oil separator of Test product 1 of the two types of the oil separator prepared (Test products 1 and 2) from the gas introduction port at a flow rate of 70 L/min. In this state, the flow rates of the blowby gas respectively flowing in the vicinity of the upper part, middle part and lower part of the gradually increasing section of the plate-shaped rib were measured by using well-known means. The results are shown in Table 1 below. Incidentally, the upper part of the gradually increasing section of the plate-shaped rib for measuring the blowby gas flow rate is positioned at an upper end of the gradually increasing section that is in contact with the top plate section of the cylinder head cover, the lower part is positioned at a lower end of the gradually increasing section that is in contact with the bottom of the casing, and the middle part is positioned at a central section in the height direction of the gradually increasing section.

Also, separately from the above, the blowby gas was also introduced from the gas inlet into the oil separator of the Test product 2 at a flow rate of 70 L/min. In this state, flow rates of the blowby gas respectively flowing in the vicinity of the upper part, middle part and lower part of an end section of the partitioning rib opposite to the gas inlet side was measured using well-known means. The results are shown collectively in Table 1 below. Incidentally, respective positions of the upper part, middle part and lower part of the partitioning rib for measuring the gas flow rate are the same as those of the above described upper part, middle part and lower part of the plate-shaped rib of the oil separator of the Test product 1, respectively.

TABLE 1

| | Test product 1 Flow rate (m/s) | Test product 2 Flow rate (m/s) |
|---|---|---|
| Upper part | 3.70 | 1.56 |
| Middle part | 2.23 | 3.22 |
| Lower part | 1.19 | 2.71 |

As will be clear from the results of Table 1, with the oil separator of Test product 1 having the structure of the present invention, the flow rate of the blowby gas close to the plate-shaped rib becomes smaller in a stepwise manner towards the lower part of the plate-shaped rib, and the flow rate of the blowby gas in the vicinity of the lower part of the plate-shaped rib is a value that is less than ½ of the flow rate of the blowby gas in the vicinity of the upper part of the plate-shaped rib. Conversely, in the oil separator of Test product 2 having the related art structure, the flow rate of the blowby gas in the vicinity of the partitioning rib is the largest in the vicinity of the middle part of the partitioning rib, intermediate in the vicinity of the lower part of the partitioning rib, and the smallest in the vicinity of the upper part of the partitioning rib. From these facts, according to the present invention, it is clearly recognized that the flow rate of the blowby gas at the bottom of the common flow path section can be effectively reduced by providing the flow passage regulating section for regulating the width of the common flow path section so that the width of the common flow path section becomes gradually smaller towards the bottom thereof.

Specific structure of the present invention has been described in detail above, but this is merely an illustrative example, and the present invention is not limited in any way by the above disclosure.

For example, with the two embodiments described above, the separation means are constituted by the baffle plate 44 and the impingement plate 46 for separating the oil from within the blowby gas using an inertia collision method, but instead off this, or in addition to this, it is possible to appropriately adopt a structure for separating the oil from within the blowby gas using a labyrinth method disclosed in JP-U-A-63-105712 etc., or a structure for separating the oil from within the blowby gas using a cyclone method disclosed in JP-A-2001-246216, etc.

Figure 6:
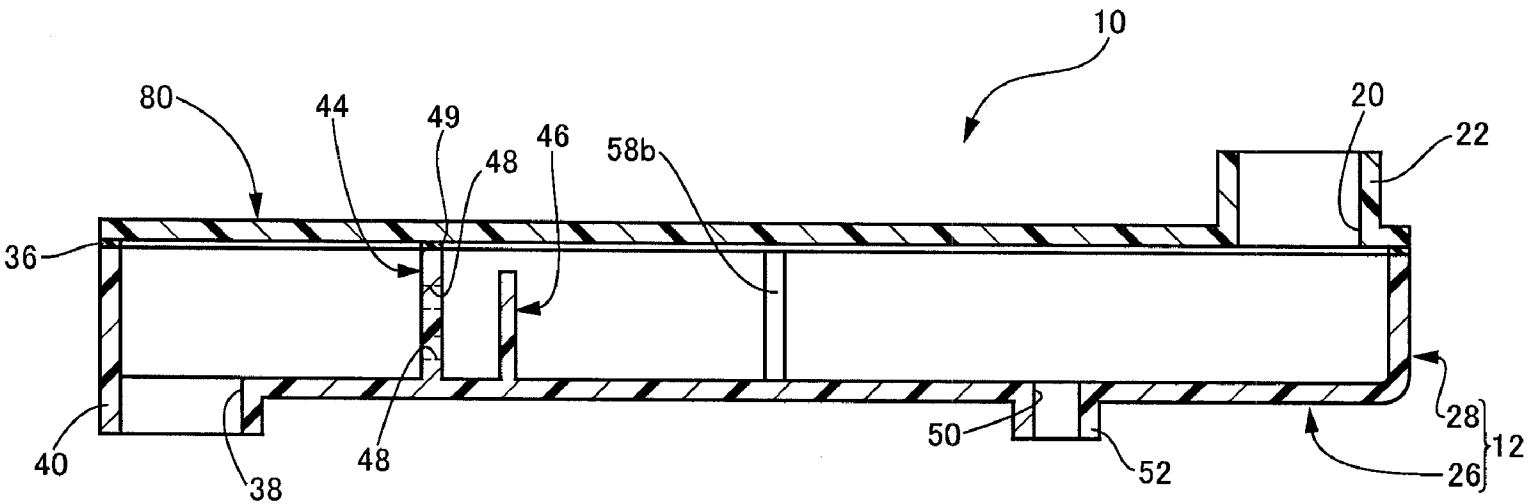
FIG. 6 is a view corresponding to FIG. 1 showing another embodiment of an oil separator for blowby gas according to the present invention.

Also, with the two embodiments described above, the casing 12 is attached to the cylinder head cover 14, and integrated with the cylinder head cover 14, but as shown in FIG. 6, for example, there may be employed a structure where an upper opening section of the casing 12 is covered by a lid body 80 formed from a separate member, and the casing 12 and the lid body 80 are fitted together, to give a separate assembly that is independent of the cylinder head casing.

If an oil separator 10 is constructed independently from the cylinder head cover 14, for example, the oil separator 10 is connected midway along a connecting passage provided between the crank case and the intake piping so as to connect them together. That is, the connecting passage has a divided structure split in two, being an upstream section and a downstream section in the flow direction of the blowby gas, and by connecting the upstream section to the gas intake 38 of the casing 12 and connecting the downstream section to the gas outlet port 20 of the lid body 80, the oil separator 10 is provided midway along the connecting passage. Also, at this time, the oil discharge port 50 is connected to an oil discharge pipe linked to an oil pan of the engine.

Also, in the two above-described embodiments, the flow passage regulating section is constituted by the plate-shaped rib 58, but this passage regulating section is not particularly limited as long as a part of the width of the common flow path section 56 is regulated so as to become gradually smaller towards the bottom of the common flow path section, to form the restricted section 60. Accordingly, for example, it is also possible for the bottom 26 and the side wall section 28 of the casing surrounding the common flow path section 56 to project partially towards the inside, and to construct the passage formation section using this projecting section. In the case of constructing the passage regulating section using the plate-shaped rib 58, it is also possible to form an sloping section in a curved shape or in a stepped shape. Of course, in the case of making the sloping section an inclined surface also, the inclination angle is not particularly limited.

The overall shape of the casing 12 can also be any shape.

In addition, besides an oil separator for the blowby gas fitted to a vehicle engine, the present invention can be advantageously adopted for any oil separator for the blowby gas for separating the oil from within the blowby gas generated inside an internal engine other than the vehicle engine.

It is to be understood that the present invention may be embodied with various other changes and modifications which may occur to those skilled in the art, without departing from the spirit and scope of the invention defined in the following claims.

What is claimed is:

1. An oil separator for a blowby gas containing oil, comprising:

a gas flow passage, provided with a gas inlet port and a gas outlet port for the blowby gas, for allowing a flow of the blowby gas from the gas inlet port towards the gas outlet port;

separation means, provided midway along the gas flow passage, for separating the oil from within the blowby gas which flows inside the gas flow passage;

an oil passage, at least a part of which is formed as a common flow path section located downstream of the separation means in the blowby gas flowing direction and shared by the gas flow passage, for allowing the oil separated by the separation means to flow along a bottom of the common flow path section; and an oil discharge port, provided at a downstream side section, in the oil flowing direction, of the oil passage, for discharging the oil which flows inside the oil passage to the outside of the oil passage, wherein a flow passage regulating means is provided in the common flow path section so as to extend upwards from the bottom of the common flow path section, and wherein the flow passage regulating means makes a part of the common flow path section a restricted portion, by regulating a width of the part of the common flow path section so that the width becomes gradually narrower towards the bottom of the common flow path section.

2. The oil separator according to claim 1, wherein the oil discharge port and the gas outlet port are respectively provided at different positions in the width direction of the common flow path section, and a part of the restricted portion of the common flow path section which has a minimum width is arranged to be positioned towards a side of the common flow path section, in the width direction, where the oil discharge port is provided.

3. The oil separator according to claim 2, further comprising:

an oil passage downstream section located on the downstream side of the common flow path section in the oil flowing direction, the oil passage downstream section having a bottom connected to the bottom of a minimum width section of the restricted portion, and a gas flow passage downstream section located on the downstream side of the common flow path section in the blowby gas flowing direction, wherein the gas flow passage downstream section and the oil passage downstream section extend in different directions.

4. The oil separator according to claim 3, wherein the gas flow passage downstream section extends in a direction that is opposite from the extending direction of the oil passage downstream section.

5. The oil separator according to claim 1, wherein the flow passage regulating means is formed from at least one plate-shaped rib arranged so as to extend integrally upwards from the bottom of the common flow path section, at a mid point of the common flow path section, so that the flow of the blowby gas inside the common flow passage is partially blocked by one surface in the thickness direction of the at least one plate-shaped rib, and the at least one plate-shaped rib has a gradually decreasing section, of which a height gradually decreases towards the bottom of the common flow path section to restrict the width of the restricted portion of the common flow path section, so that the width of the restricted portion becomes gradually narrower towards the bottom of the common flow path section.

6. The oil separator according to claim 5, wherein an upper region of the at least one plate-shaped rib is constituted by the gradually decreasing section, and a lower region of the plate-shaped rib is constituted by an extension section which extends in the width direction of the common flow path section beyond the gradually decreasing section and is shorter than the entire width of the common flow path section.

7. The oil separator according to claim 1, wherein the gas flow path extends to make a U-turn.

8. The oil separator according to claim 1, wherein the gas flow passage has an expanded section, of which a cross sectional surface area is enlarged, and the expanded section is provided downstream of the flow passage regulating means of the gas flow passage in the blowby gas flowing direction.

* * * * *